US005257582A

United States Patent [19]

Helton

[11] Patent Number: 5,257,582

[45] Date of Patent: Nov. 2, 1993

[54] VAULT CAPACITY EXPANSION SYSTEM

[75] Inventor: Gerald T. Helton, Santa Barbara, Calif.

[73] Assignee: Santa Barbara Bank & Trust, Santa Barbara, Calif.

[21] Appl. No.: 989,139

[22] Filed: Dec. 11, 1992

[51] Int. Cl.[5] ..... E05G 1/08

[52] U.S. Cl. ..... 109/45; 109/49; 109/57

[58] Field of Search ..... 109/45, 49, 53, 56, 109/57

[56] References Cited

U.S. PATENT DOCUMENTS

| | | | |
|---|---|---|---|
| 159,380 | 2/1875 | Barnes | 109/45 |
| 193,214 | 7/1877 | Bemis | 105/89 |
| 371,545 | 10/1887 | Bromwell | 105/89 |
| 2,166,704 | 7/1939 | Foulkes | 214/16 |
| 2,174,260 | 9/1939 | Foulkes | 214/16 |
| 3,427,085 | 2/1969 | Staller | 312/200 |
| 3,837,299 | 9/1974 | McClellan | 109/56 |
| 3,837,300 | 9/1974 | Karr | 109/57 |
| 3,970,010 | 7/1976 | Cantley | 109/56 |
| 4,557,201 | 12/1985 | Webb, Jr. | 109/45 |
| 4,724,774 | 2/1988 | Wiedemar et al. | 109/48 |
| 4,789,210 | 12/1988 | Weiss et al. | 312/201 |
| 4,947,766 | 8/1990 | Collier, Jr. | 109/56 |
| 5,062,535 | 11/1991 | Potter | 211/162 |

FOREIGN PATENT DOCUMENTS

| | | | |
|---|---|---|---|
| 0115365 | 8/1984 | European Pat. Off. | 109/53 |
| 617966 | 8/1935 | Fed. Rep. of Germany | 109/49 |
| 2140587 | 2/1973 | Fed. Rep. of Germany | 109/53 R |
| 3241442 | 5/1984 | Fed. Rep. of Germany | 109/53 |
| 2613411 | 10/1988 | France | 109/53 |

*Primary Examiner*—Lloyd A. Gall
*Attorney, Agent, or Firm*—Marvin E. Jacobs

[57] ABSTRACT

In an existing vault having arrays of safe deposit boxes along the walls, a mobile carriage carrying additional safe deposit boxes is adapted to roll along rails in front of the fixed boxes, within the volume of space reserved to allow extraction of the fixed boxes, so as to add capacity to the vault without interfering with convenient access.

4 Claims, 1 Drawing Sheet

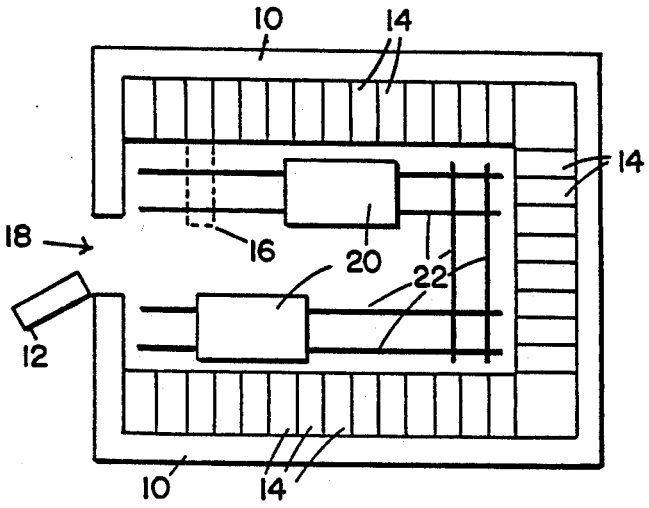
FIG. 1
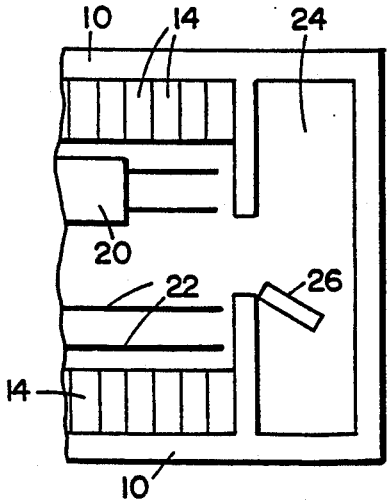
FIG. 2
FIG. 3
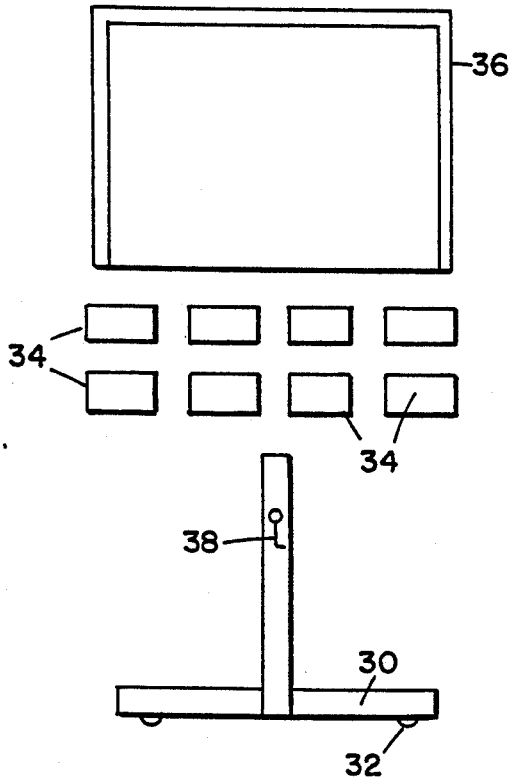
FIG. 4
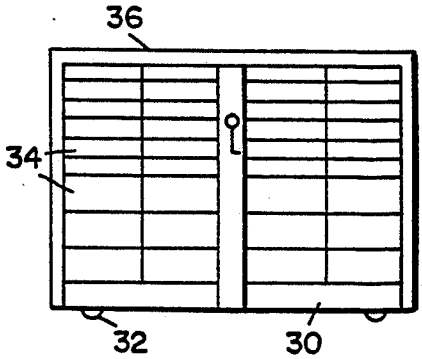

VAULT CAPACITY EXPANSION SYSTEM

TECHNICAL FIELD

This invention relates to safe deposit box containing vaults typically found in banks and similar institutions. More specifically, an expansion storage system is disclosed that allows more safe deposit boxes to be incorporated into an existing vault without blocking passageways in and out of the vault.

BACKGROUND OF THE INVENTION

Because of their high quality and secure construction, vaults are a very expensive part of the infrastructure of a bank or like facility. Hence, they are generally made as small as possible consistent with the secure storage requirements of the institution. Customers of banks, however, often insist upon having a personal safe deposit box in the bank within which they do business. Thus, it eventually becomes necessary to add additional safe deposit box capacity to accommodate an expanding customer base.

A new vault is inordinately expensive. And existing vaults are quite compact and efficient already, preventing the addition of any new boxes. This problem is made more acute in an age of bank consolidation where customers from several institutions may be folded into one institution with one vault. The present invention solves this problem by providing a way to fit additional safe deposit boxes into existing vaults.

STATEMENT OF THE INVENTION

Briefly, all vaults have, by necessity, a volume of space immediately in front of the safe deposit boxes that must be kept empty so as to permit extraction of the boxes thereinto. A typical vault is sized to have a stack of safe deposit boxes along one or more walls, an extraction volume in front of the stack, and a passageway in front of the extraction volume within which users can walk. The depth of the extraction volume corresponds approximately to the length of the safe deposit boxes while the width and height of the volume correspond to the width and height of the stack of boxes.

The instant invention makes double use of the extraction volume by providing a movable carriage sized to fit and move within the extraction volume. A collection of safe deposit boxes is stacked on the carriage so as to add additional new boxes inside the existing vault space. The carriage is adapted to follow tracks that are parallel to the face of the wall mounted existing safe deposit boxes. In addition, the carriage incorporates a crank system that allows it to be manually rolled along the tracks so as to access wall mounted boxes that may be behind the carriage carried boxes. New boxes on the carriage may be stacked as high as the vault ceiling and the carriage may be up to one half the width of the wall behind it. In one embodiment, the stack on the carriage may be terminated at about counter height to create a counter-like work surface ideal to provide a resting place for extracted safe deposit boxes. These and other benefits and advantages will become apparent upon consideration of the following more detailed description and the drawing referenced thereby.

BRIEF DESCRIPTION OF THE DRAWINGS

FIG. 1 is a schematic plan representation of a typical vault arrangement with the present inventive mobile safe deposit carriage incorporated therein.

FIG. 2 is a fragmentary drawing similar to the right side of FIG. 1, except showing a vault with a rear separate cash locker.

FIG. 3 is an exploded view of the constituent parts of the mobile carriage.

FIG. 4 shows the mobile carriage with safe deposit boxes stacked thereon and an enclosing cover of a height to yield a convenient work surface.

DETAILED DESCRIPTION OF THE INVENTION

FIG. 1 schematically shows a typical existing vault with a secure enclosing wall 10 and a door 12. A plurality of fixed safe deposit boxes 14 are stacked along the interior of wall 10. To access a box, the front cover is unlocked and an interior box withdrawn approximately to the position exemplified by dashed line 16. All of the boxes 14 are elongated, as shown, and require a volume of space to be preserved in front of the collection of boxes into which the interior boxes can be withdrawn. This extraction space or volume has a depth equal to the box depth, exemplified by dashed line 16, and extends every where over the interior face of the collection of boxes 14. Beyond the extraction volume, a walk space 18 is maintained down the center of the vault.

Since not all of the boxes 14 need to be accessed at the same time, the present invention adds additional mobile safe deposit box storage within the extraction volume. One or more carriages 20 are positioned to roll along rails 22. Rails 22 are parallel to and just in front of boxes 14 so that carriages 20 always remain within the extraction volume and do not enter and block walk way 18. Hence, the walk space is not reduced. Also, all the fixed boxes 14 remain useable since mobile carriages 20 can be rolled out of the way of any boxes that may be behind the carriages. To insure complete access, carriages 20 cannot exceed fifty percent of the wall length, as measured along the rails 22. However, if desired, the carriages may be expandable to any height up to the vault ceiling.

For clarity, no carriage is shown at the rear of the vault in FIG. 1, but suitable cross rails are provided there as well. The rear of the vault often is alternatively equipped with a cash locker 24 behind a door 26 as shown in FIG. 2. In this case, the rear cross rails are eliminated. However, it should be noted that the movable carriages 20 along the side walls do not block access to a rear cash locker 24 when installed in the common types of existing vaults.

The carriage 20 is shown in an exploded view in FIG. 3 and an assembled view in FIG. 4. A platform 30 is provided with rail following wheels 32. Safe deposit boxes 34, which may be of various sizes, are stacked on platform 30 and the top, sides, and back of the stack are enclosed with a cover 36. Boxes 34 can be identical to the standard fixed boxes 14 used along walls 10. These standardized boxes are shaped to stack on top of each other and bolt together in a manner well known to those skilled in the art. The resultant stack may be very heavy when the boxes are eventually filled with customer valuables. Thus, a crank assist system 38 is provided. Crank 38 is connected by a conventional gear and chain system to wheels 32 so that carriage 20 can be rolled along floor rails 22 simply by turning crank 38.

In the embodiment shown, the height of the cover 36 and boxes 34 is chosen to be at a convenient counter height so that extracted boxes may be rested on the top. In this way, carriage 20 also provides the enhanced convenience of a work counter within the vault. For maximum additional storage, however, carriage 20 is extended to the full vault height. Many variations of the carriage design are possible within the spirit and scope of the invention. Accordingly, limitation only by the appended claims and their equivalents is appropriate.

I claim:

1. A vault expansion system for vaults having a plurality of fixed safe deposit boxes arrayed on the interior walls thereof and an extraction volume space in front of the fixed boxes in order to permit the fixed boxes to be extracted thereinto, the improvement comprising a movable carriage also adapted to hold within said extraction volume, said carriage also adapted to hold a collection of safe deposit boxes stacked thereon, said safe deposit boxes fastened together to form said collection, said collection enclosed within a security cover on the top, back, and sides, but not over the safe deposit box doors, to prevent separation of said boxes, said carriage also having wheels shaped to roll along rails disposed parallel to and along the front of said fixed safe deposit boxes, and said collection of safe deposit boxes on said carriage being of a size approximately half the length of the array of fixed boxes as measured parallel to said rails, said carriage securely connected to said security cover so as to move said collection only within said extraction volume.

2. The system of claim 1 in which said carriage includes a hand crank connected to turn said wheels and assist movement of the carriage along said rails.

3. The system of claim 1 in which said collection of boxes on the carriage are of a height such as to provide a convenient height mobile work surface.

4. The system of claim 3 in which said carriage includes a hand crank connected to turn said wheels and assist movement of the carriage along said rails.

* * * * *